United States Patent [19]

Lippa

[11] 4,268,001

[45] May 19, 1981

[54] MOLD FOR CASTING CERAMIC MATERIALS

[75] Inventor: Giuseppe Lippa, Brescia, Italy

[73] Assignee: American Standard Inc., New York, N.Y.

[21] Appl. No.: 156,972

[22] Filed: Jun. 6, 1980

[30] Foreign Application Priority Data

May 23, 1979 [IT] Italy ..... 46845 A/79

[51] Int. Cl.[3] ..... B28B 7/16

[52] U.S. Cl. ..... 249/58; 249/160; 249/142

[58] Field of Search ..... 249/58, 142, 160; 425/405 H, DIG. 44

[56] References Cited

U.S. PATENT DOCUMENTS 2,565,356 8/1951 Crane et al. ..... 249/58
3,618,179 11/1971 Anderson et al. ..... 425/405 H
3,645,490 2/1972 Beasley ..... 249/160 X
3,664,799 5/1972 Wallick et al. ..... 425/405 H X
4,133,626 1/1979 Shubart ..... 425/405 H

*Primary Examiner*—J. Howard Flint, Jr.
*Attorney, Agent, or Firm*—James J. Salerno, Jr.; Robert G. Crooks; John P. Sinnott

[57] ABSTRACT

A mold for casting ceramic material in slip form is disclosed. The mold comprises a plurality of mold parts of which one constitutes a seat made of a non-casting material, the other mold part or parts being made of casting plaster, a surface region of the seat, in the assembled mold, forming part of the casting cavity, which surface region is bounded by closely adjacent region of the other mold part or parts such that during casting a solid cast portion of the article is cast against the seat, the mold parts being adapted so that the mold can be opened after casting to leave the article on the seat whereby the article can be lifted away on the seat.

10 Claims, 3 Drawing Figures

MOLD FOR CASTING CERAMIC MATERIALS

BACKGROUND OF THE INVENTION

This invention relates to a mold for casting ceramic material in slip form and particularly, although not exclusively, for casting articles of sanitary ware of vitreous china.

Traditionally, a seat is a portable carrier quite separate from the mold for use when the mold is opened, the seat being positioned against or under the article which is then shifted by moving the article or the mold part against which the article rests, so that its weight is taken by the seat. The article can then be lifted clear of the mold and left to stand on the seat while it dries. Commonly, seats were made of plaster, wood or other durable, lightweight material.

It has been proposed to adapt one of the mold parts itself to serve as a seat so that the article is lifted away, after casting, on that mold part but hitherto it has been thought that it was necessary always to make all the mold parts, including the one to serve as a seat, from plaster since all the mold parts which have surfaces which define part of the casting cavity must be capable of shaping the article. Thus, when ceramic slip is introduced into the mold cavity, moisture is absorbed from the slip into the plaster of the mold parts, the ceramic material thereby casting up against the inside surfaces of the casting cavity. Sometimes a plug of non-casting material is included in the mold cavity, or a portion of the casting surface can be coated with a resin, to prevent casting in that region, but this has been done only to avoid casting up of the slip at a region of the article where a hole or other opening is to be formed.

SUMMARY OF THE INVENTION

A mold according to the present invention comprises a plurality of mold parts of which one constitutes a seat made of a non-casting material, the other mold part or parts being made of casting plaster, a surface region of the seat, in the assembled mold, forming part of the casting cavity, which surface region is bounded by closely adjacent regions of the other mold part or parts such that during casting a solid cast portion of the article is cast against the seat, the mold parts being adapted so that the mold can be opened after casting to leave the article resting on the seat whereby the article can be lifted away on the seat.

It has now been found unexpectedly that a seat mold part made of a non-casting material can be used provided the surface region of the seat mold part which is exposed in the mold cavity, is bounded by closely spaced regions of one or more mold parts made of plaster so that during casting, a solid cast portion of the article is cast up against the exposed surface of the seat mold part.

This has several advantages. First, a seat mold part made of a non-casting material such as plastics material can be used repeatedly without limit on the number of times of use, whereas one made of plaster has a limited life, like all plaster parts.

Secondly, because plaster is a brittle material, repeated use of a plaster seat mould part would lead to its becoming damaged particularly on its edge regions and such damage would appear as faults in the cast article. A seat made of a non-casting material can be made less brittle and at the same time softer than plaster so that it will not damage adjacent plaster mold parts.

Thirdly, by using a non-expendable material for the seat a stock of many seat mold parts which do not wear out may be provided economically so that fresh ones are always available at the end of one casting operation for use in the next casting operation, in place of the ones on which the articles, just cast, are drying.

Finally, a seat mold part made of a non-casting material can be made lighter in weight than a corresponding seat mold part made of plaster. This is important where the cast article has to be removed from the mold by manually lifting it on the seat; of course where mechanical lifting apparatus is used the weight of the seat is not so important.

Preferably the said closely spaced plaster surfaces of the other mold part or parts extend generally perpendicular to the surface region of the seat and are generally parallel to each other so that there is cast between the generally parallel plaster surfaces a solid cast parallel-sided wall portion of an article, which wall terminates at the seat surface.

If the article is to have a hollow, i.e. downwardly open, region in its lower portion, relative to its cast position in the mold, the seat mold part is preferably annular so that a core part can project upwardly through the center of the seat to shape the inside of the hollow region in the article. The annular seat may be arranged to rest on the core part, the core part thereby forming a foot part of the mold. Such a construction is suitable for a mold for casting a water-closet bowl or bidet or the like, in its upright position so that the pedestal portion of the bowl comprises an annular solid cast wall the lower rim of which is cast against the annular seat.

Such an embodiment is advantageous for each mold of an installation for casting water-closet bowls, bidets, or the like, comprising a plurality of molds arranged side-by-side in a line on a longitudinally extending support structure, each mold comprising two side mold parts which are substantially similar relative to a vertical parting plane, and which are shaped to form half of the bowl, each side part, apart from those at each end of the line, being connected with the adjacent side mold part of the next adjacent mold in the line, an upper mold part adapted to rest on the side mold parts to close the top of the casting cavity and being shaped to form the rim of the bowl, a lower core part comprising a core piece for shaping the bottom portion of the article, and a seat ring, constituting the said seat made of non-casting material, removably located on the core part to surround the core.

BRIEF DESCRIPTION OF THE DRAWINGS

The invention may be carried into practice in a number of ways but one specific embodiment will now be described by way of example with reference to the accompanying drawings, in which.

DESCRIPTION OF THE PREFERRED EMBODIMENT

Figure 1:
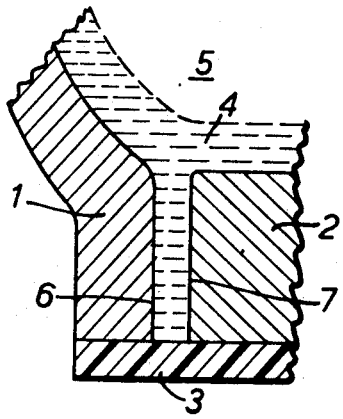
FIG. 1 shows part of a mold in accordance with the invention.

FIG. 1 shows a detail of a mold, in which there are shown three mold parts, namely two plaster parts 1 and 2 made of pervious plaster of Paris, and a seat 3 made of a non-casting material, i.e. a material at least the surface of which is impervious to water so that the seat material is not appreciably capable of absorbing water from the slip. The seat 3 may be made entirely of a non-porous material or it may be made of a porous material which is treated at least on that surface which is exposed in the casting cavity to make the surface non-casting and the seat durable.

When the slip 4 is introduced into the mold it fills the cavity including the narrow space between the two opposed closely-spaced parallel surfaces 6 and 7 of the plaster parts 1 and 2 which extend perpendicularly to the surface of the seat 3, the lower surface of that narrow space being bounded by the exposed surface of the seat 3. Owing to the fact that the surfaces 6 and 7 are closely spaced, a solid cast region is formed between them right down to the surface of the seat 3. The surfaces 6 and 7 are, in a specific construction, spaced apart by a distance of about 11 mm but it is believed that satisfactory casting can be achieved with a spacing up to 15 mm. The region 5 may be occupied by a core or it may be filled with slip which is subsequently drained to leave a drain cast hollow region in the article. After casting, the mold may be opened to leave the article resting on the seat 3 so that the article can be lifted away on the seat 3.

Figure 2:
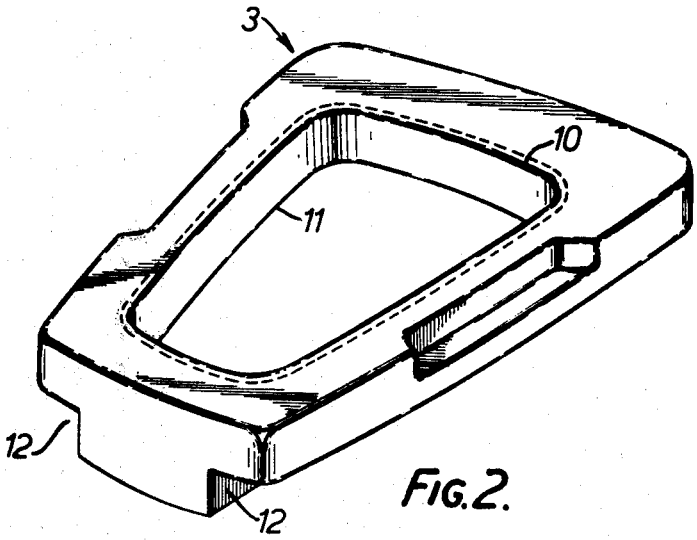
FIG. 2 shows a seat mold part for a mold in accordance with the invention for casting a water-closet bowl.

FIG. 2 shows a seat ring 3 made of a foamed polyurethane material which is light in weight, rigid and strong but not hard, and not capable of casting, i.e. substantially non-absorbent to water on its surfaces; the polyurethane material may be made by mixing two components, e.g. a poly-hydric alcohol and an isocyanate.

The seat ring 3 is adapted to rest on the foot core of a mold for casting a water-closet bowl, the lower, annular rim of the pedestal of the bowl being cast against the seat 3 on the annular surface region 10 on the upper surface of the seat 3, as indicated by a dash line, surrounding the central aperture 11 through which the core of the foot core projects. The seat 3 also has two undercuts 12 extending along opposite sides for receiving the fork elements of a fork lift mechanism.

Figure 3:
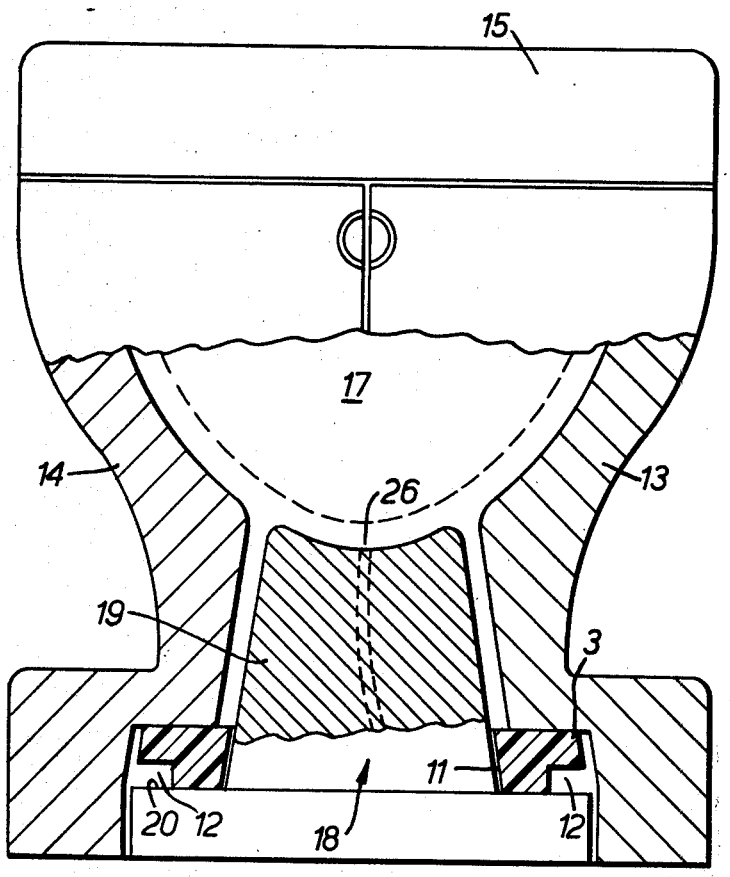
FIG. 3 shows a mold for casting a water-closet bowl, including the seat mold part as shown in FIG. 2.

A seat ring 3 as shown in FIG. 2 is incorporated in the mold shown in FIG. 3. The mold shown in that Fig. is a mold for casting a water-closet bowl in an upright position. The mold comprises in addition to the seat 3, two plaster side mold parts 13 and 14 which are symmetrical about a vertical parting plane and which are shaped to form half the exterior of the bowl, an upper mold part 15 made of plaster, adapted to rest on the side mold parts 13 and 14 to close the top of the mold cavity 17 and being shaped to form an integrally cast flush-water rim of the bowl, and a plaster foot core 18 which has a core 19 for shaping the hollow region inside the pedestal of the bowl, extending upwardly through the central aperture 11 in the seat 3, and which also has a wide base portion with an annular ledge 20 upon which the seat 3 rests.

For casting, the mold is cleaned and assembled by clamping the side mold parts 13 and 14 together on the foot core 18, and then assembling the upper mold part 15 and claimping it against vertical displacement. The mold cavity is then filled with slip via a filling aperture 26 in the core 19. The slip flows into the annular space between the side parts 13, 14 and the core 19 and fills the entire cavity in the mold. The full mold is then left for a casting time with the slip maintained under slight pressure. During this time the annular wall 27 which forms the pedestal of the bowl in the mold will cast up in the annular space between the plaster core 19 and the plaster side parts 13, 14 to form a solid cast wall extending right down to the non-casting surface of the seat 3.

After the casting time has elapsed, excess slip is drained, using air under pressure if required to force the excess slip from the mold, and then clamps holding the upper mold part 15 are released and the clamping of the side mold parts is also released. Then, the upper mold part is removed and one of the side mold parts is moved horizontally out of contact with the cast bowl, the bowl resting on the seat 3 and foot core 18. The upper surface of the seat 3 is not completely flat but has very slight downward and outward inclination, termed "draw", so that the side parts 13 and 14 do not scrape against the upper surface of the seat 3 when they are separated. The other side part of the mold and the foot core 18 are then separated from each other by horizontal movement leaving the soft cast bowl standing freely on the seat 3 and the foot core 18.

The cast bowl is then lifted away from the foot core 18 by lifting the seat 3 either manually or using a mechanical fork lift mechanism if required, with the fork elements inserted in the gaps afforded by the undercut portions 12 at each side of the seat 3, and the seat and bowl are then put on a drying bench nearby where the bowl stays on the seat 3 for a pre-determined drying time. A fresh seat ring 3 is then put over the foot core 18 which is then re-assembled with the side mold parts.

The cycle of operation is then repeated; thus, as the mold is emptied and a fresh seat 3 positioned on the foot core 18, the mold is also prepared for the next casting cycle.

The seats 3 are very light and strong, yet because the polyurethane material is soft they do not damage the foot cores 18 as they are repeatedly put on and lifted off the latter, nor does the annular edge 28 of each seat 3 become chipped as occurs when the seats are made of plaster.

The seats 3 are economical to produce bearing in mind that they can be used indefinitely unlike plaster mold parts which can only be used for about one hundred or so casting operations before the plaster loses its casting properties.

The use of the seats 3 made of a durable, lightweight material is particularly advantageous in multiple casting of water-closet bowls in a plurality of such molds arranged in a line with the side mold parts and foot cores supported on trolleys which are movable along the line, since the removal of the water-closet bowls on the seats 3 is readily facilitated and fresh seats are available for re-assembly with the molds ready for the next casting cycle. The repeated use of the seats 3, continually putting them on and then taking them off the foot cores 18 cause no damage at all to the molds or seats.

What is claimed:

1. A mold comprising a plurality of mold parts of which one constitutes a seat made of a non-casting material, the other mold part or parts being made of casting plaster, a surface region of the seat, in the assembled mold, forming part of the casting cavity, which surface region is bounded by closely adjacent regions of the other mold part or parts such that during casting a solid cast portion of the article is cast against the seat, the mold parts being adapted so that the mold can be opened after casting to leave the article resting on the seat whereby the article can be lifted away on the seat.

2. The mold as claimed in claim 1, in which the seat is made of a plastics material.

3. The mold as claimed in claim 2, in which the plastics material is a rigid, foamed plastics with a water impervious surface.

4. The mold as claimed in claim 3, in which the plastics material is a polyurethane.

5. The mold as claimed in claim 1, in which the said closely spaced plaster regions of the other mold part or parts extend generally perpendicular to the surface region of the seat and are generally parallel to each other so that there is cast between the generally parallel plaster surfaces a solid cast parallel-sided wall portion of an article, which wall terminates at the seat surface.

6. The mold as claimed in claim 1, in which the casting cavity is shaped for casting an article having a hollow, downwardly open region in its lower portion, relative to its cast position in the mold, the seat being annular, and a core part, in the assembled mold, projecting upwardly through the central aperture of the seat, for shaping the inside of the hollow region in the article.

7. The mold as claimed in claim 6, in which the seat has two undercuts extending along opposite sides for receiving the fork elements of a fork lift mechanism.

8. The mold as claimed in claim 6, in which the seat rests on a foot core of the mold.

9. The mold as claimed in claim 8, in which the mold cavity is shaped for casting a water-closet bowl, bidet or the like, in an upright position so that the pedestal portion of the bowl comprises an annular solid cast wall the lower rim of which is cast against the annular seat.

10. An installation for casting water-closet bowls, bidet or the like, comprising: a plurality of molds arranged side-by-side in a line on a longitudinally extending support structure, each mold cavity being shaped for casting a water-closet bowl bidet or the like, in an upright position so that the pedestal portion of the bowl includes an annular solid cast wall the lower rim of which is cast against the annular seat and including two side mold parts which are substantially similar relative to a vertical parting plane, and which are shaped to form half of the bowl, each side part, apart from those at each end of the line, being connected with the adjacent side mold part of the next adjacent mold in the line, an upper mold part adapted to rest on the side mold parts to close the top of the casting cavity and being shaped to form the rim of the bowl, a lower core part comprising a core piece for shaping the bottom portion of the article, and a seat ring, constituting the said seat made of non-casting material, removably located on the core part to surround the core.

* * * * *